US008851863B2

(12) United States Patent
Etter et al.

(10) Patent No.: US 8,851,863 B2
(45) Date of Patent: Oct. 7, 2014

(54) GAS BOOSTER SYSTEM AND RELATED METHOD

(75) Inventors: Thomas M. Etter, Southington, CT (US); Jon G. Moore, Hamden, CT (US); Patrick M. Hale, Thomaston, CT (US)

(73) Assignee: Etter Engineering Company, Inc., Bristol, CT (US)

( * ) Notice: Subject to any disclaimer, the term of this patent is extended or adjusted under 35 U.S.C. 154(b) by 348 days.

(21) Appl. No.: 12/688,668

(22) Filed: Jan. 15, 2010

(65) Prior Publication Data

US 2010/0183461 A1 Jul. 22, 2010

Related U.S. Application Data

(60) Provisional application No. 61/145,410, filed on Jan. 16, 2009.

(51) Int. Cl.

| | |
|---|---|
| ***F04D 25/06*** | (2006.01) |
| ***F04D 29/40*** | (2006.01) |
| ***F04D 29/58*** | (2006.01) |
| ***F04D 29/60*** | (2006.01) |
| ***F04D 29/62*** | (2006.01) |

(52) U.S. Cl.

CPC ..... *F04D 29/403* (2013.01); *F04D 25/06* (2013.01); *F04D 29/624* (2013.01)

USPC ..... 417/360; 417/423.14; 417/423.15; 417/366; 248/612; 248/637; 248/676; 248/678

(58) Field of Classification Search

CPC ..... F04D 25/06; F04D 25/08; F04D 29/60; F04D 13/0606

USPC ..... 417/360, 423.15, 423.7, 366, 423, 14; 248/612, 637, 645, 646, 649, 669, 670, 248/671, 676, 678

See application file for complete search history.

(56) References Cited

U.S. PATENT DOCUMENTS

| | | | | | |
|---|---|---|---|---|---|
| 1,471,559 | A * | 10/1923 | Enauf | 417/359 |
| 1,491,423 | A * | 4/1924 | Rice | 60/687 |
| 2,711,285 | A * | 6/1955 | Burrowes | 417/353 |
| 3,797,961 | A * | 3/1974 | Brechbuhl | 415/126 |
| 4,394,549 | A * | 7/1983 | Dennis | 200/16 E |
| 5,085,396 | A * | 2/1992 | Mansson | 248/678 |
| 5,100,302 | A * | 3/1992 | Ceccherini | 417/360 |
| 5,428,256 | A * | 6/1995 | Schloss | 310/87 |
| 5,798,910 | A * | 8/1998 | Holbeche et al. | 361/809 |
| 5,868,175 | A * | 2/1999 | Duff et al. | 141/59 |
| 5,925,999 | A * | 7/1999 | Lakerdas et al. | 318/496 |
| 6,439,861 | B1 * | 8/2002 | Shieh | 417/371 |
| 6,817,845 | B2 * | 11/2004 | Angle et al. | 417/423.7 |

(Continued)

*Primary Examiner* — Peter J Bertheaud
*Assistant Examiner* — Dominick L Plakkoottam

(57) ABSTRACT

An improved booster for use in piped fluid systems includes a motor, a fan wheel and a hermetically sealed tank assembly. Fluids enter the tank assembly through an inlet and are compressed within the tank assembly by a rotating fan wheel, before leaving the tank assembly through an outlet, which may be aligned in a plurality of angular configurations. The motor is powered by a versatile electrical connection which enters the tank assembly through a connector that maintains the hermetically sealed condition in the tank assembly, and can accommodate power of any voltage or frequency. The incremental pressure gain provided by the booster may be controlled by modifying the speed of the rotating fan wheel, and a sled assembly provides structural support and positional alignment for portions of the tank assembly when the booster system is opened for access.

16 Claims, 8 Drawing Sheets

(56) References Cited

U.S. PATENT DOCUMENTS

| | | | | |
|---|---|---|---|---|
| 6,899,516 | B2 * | 5/2005 | Wang | 415/60 |
| 7,074,017 | B2 * | 7/2006 | Coray et al. | 417/360 |
| 7,077,627 | B2 * | 7/2006 | Kupferberg | 415/201 |
| 2004/0011710 | A1 * | 1/2004 | Kato et al. | 209/21 |
| 2004/0037715 | A1 * | 2/2004 | Bader et al. | 417/366 |
| 2004/0179957 | A1 * | 9/2004 | Choroszylow et al. | 417/313 |
| 2005/0099075 | A1 * | 5/2005 | Roslund et al. | 310/85 |
| 2006/0066155 | A1 * | 3/2006 | Matin et al. | 310/52 |
| 2006/0269394 | A1 * | 11/2006 | Ishikawa et al. | 415/55.1 |
| 2007/0110596 | A1 * | 5/2007 | Weeber et al. | 417/370 |
| 2009/0238687 | A1 * | 9/2009 | Lin | 415/214.1 |
| 2011/0031830 | A1 * | 2/2011 | Oleson et al. | 310/88 |

* cited by examiner

GAS BOOSTER SYSTEM AND RELATED METHOD

CROSS-REFERENCE TO RELATED APPLICATIONS

This application claims the benefit of and priority to U.S. Patent Application No. 61/145,410, filed Jan. 16, 2009, the content of which is incorporated herein by reference in its entirety.

BACKGROUND OF THE INVENTION

1. Field of the Invention

The present invention relates to fluid systems and, more particularly, to an improved system for increasing pressure in piped fluid systems, and related methods.

2. Background of the Related Art

In piped fluid systems, pumps or similar machines are sometimes used to elevate the pressure of the fluid, in order to overcome supply pressure deficiencies or pipe losses, to satisfy equipment pressure requirements (particularly in modern, low-emission or high-efficiency equipment), or for any other desired reason. Commonly called "boosters," such systems and related methods perform mechanical work on fluid received at the inlet, thereby increasing the pressure of the fluid discharged at the outlet.

Booster systems and methods may be used to increase the pressure of piped gases such as natural gas, propane or propane-air mixtures, air, digester gas, landfill gas, and others. Gas boosters are commonly installed upstream of commercial or industrial natural gas-fired or propane-fired equipment, such as rooftop heating, ventilation and air conditioning (HVAC) units, boilers, process heat systems, heat-treating furnaces, incinerators, gas-fired coolers, standby generators or other machinery, which may be employed in a variety of applications. For example, U.S. Pat. No. 6,484,490 B1 to Olson et al. describes the use of a pump to provide a gaseous fuel to a combustion chamber which produces an exhaust. Gas boosters may be utilized in urban areas, particularly in such areas with older supply networks which operate at low supply pressures, or in high consumption areas (such as those with heavy extensive industrial applications) which can experience "drooping" or reduced supply pressures during periods of increased demand. Also, gas boosters may be applied to systems in remote regions which may not have sufficient pressure due to pipe losses or leaks, or for other reasons.

Gas boosters can comprise a rotating machine, sometimes called a "fan blower," comprising a housing, a fluid suction inlet, a fluid discharge outlet, a motor, a shaft, and at least one impeller or rotor, commonly called a "fan wheel." Fluid enters the housing through the inlet, and the motor rotates a shaft connected to the fan wheel, creating rotational kinetic energy. Fluid then comes into contact with a rotating fan wheel, and the rotational kinetic energy is converted to stored potential energy in the fluid, in the form of pressure. Typically, such motors may be either constant-speed or variable speed motors of any type. Furthermore, gas boosters may be operated alone or in connection with other pressure-elevating systems, and configured in series or in parallel, such as in duplex-type systems, to satisfy the necessary flow and pressure requirements of the fluid system, or to provide redundancy. Gas booster systems may also include isolation valves for isolating the fan blower or pump for maintenance or repairs, or in emergency situations; check valves, for preventing undesired directional flow; a bypass, for allowing flow through the fluid system when the gas booster is not operating or when the booster is isolated; any associated connections to the pump and/or motor, or any monitoring equipment. For the purposes of the present disclosure, those of skill in the art will recognize that the terms impeller, rotor and fan wheel may be used interchangeably, to refer to a rotating apparatus which comes into contact with and performs work on the piped fluid, thereby increasing its pressure. Similarly, those of skill in the art will also recognize that the terms fan blower and pump may be used interchangeably.

Typically, the flow capacity and pressure gain of a gas booster are functions of the booster's design characteristics. When the motor is energized, and the desired fan wheel speed is reached, the booster differential pressure (defined as the pressure difference between the inlet and the outlet) remains constant. Thus, as the fluid supply pressure to the booster fluctuates, the discharge pressure will also fluctuate by a corresponding amount, for a given constant fan wheel speed. The constant booster differential pressure is sometimes referred to as the "pressure gain" of the booster system. The maximum volumetric flow capacity of the gas booster is generally a function of the axial width of fan wheel rotating within the booster, while the maximum pressure gain is typically a function of the radial length of the fan wheel blade, which acts as a lever arm in performing work on the piped fluid. Theoretically, gas boosters may be designed to increase the pressure of fluid flowing at any flow rate, and to achieve any desired pressure gain.

Despite the aforementioned advantages associated with the use of gas boosters, there are a number of physical and operational limitations which hinder the widespread use of prior art systems and methods in piped fluid systems in general, and in natural gas or propane applications in particular. For example, in some gas boosters of the prior art, motors are typically located outside of the fluid flow path, and a shaft extends from the motor into the fan wheel housing to rotate the fan wheel and perform work on the fluid. In such systems, a fan or other heat sink must be provided to cool the electronic components of the motor, which generate heat during normal operation, and seals must be provided around the rotating shaft to prevent pressure losses in the housing, due to shaft leakage. While some gas boosters feature motors that are positioned within the path of the flowing fluid, thereby removing heat from the motor by convective heat transfer, such boosters may not be readily adapted for use with multiple sources of power, and must be manually reconfigured or adjusted to accommodate electric power at different voltage levels or frequencies. Moreover, in gas boosters of the prior art, the alignment of the discharge outlet piping is typically limited to one or a small number of standard positions, and may not be readily adjusted in the field to accommodate varying system configurations or operating conditions. This limitation tends to reduce the functionality of a typical gas booster, and also complicates its physical installation into piped fluid systems.

In view of the foregoing, a need exists for improved gas booster systems and methods for use in piped gas systems in general, and in natural gas or propane systems in particular. It is an object of the present invention to overcome one or more drawbacks and/or disadvantages of related systems and methods of the prior art.

BRIEF SUMMARY OF THE INVENTION

The present invention is directed to an improved gas booster system and related methods. In accordance with a first aspect, the present invention is directed to a gas booster system and method for use in piped gas applications, preferably comprising a tank assembly, a motor, and a rotating fan wheel. The tank assembly may further comprise an inlet, an outlet, a base, a scroll housing, and a hollow drum casing releasably mounted to the base at one end and to the scroll housing at its opposite end. The base may provide support for the motor and fan wheel within the tank assembly, and the inlet and outlet may include connections for linking the booster system to piping in a fluid system.

In a currently preferred embodiment of the present invention, the hollow drum casing is substantially cylindrically shaped, and the motor and fan wheel are supported within the tank assembly by at least one support tube, which may be mounted to the base. In one such embodiment, the drum casing and at least one support tube are aligned substantially horizontally, and are mounted to a substantially vertical portion of the base in a cantilevered fashion. In yet another such embodiment, the motor and fan wheel are aligned substantially along the longitudinal axis of the drum casing, and mounted within the tank assembly.

In accordance with another aspect of the present invention, the tank assembly is hermetically sealed with respect to the ambient atmosphere. In a currently preferred embodiment, the ends of the substantially cylindrical drum casing are flange-sealed, and releasably mounted to the base and the scroll housing by threaded connections or other suitable fastening means (such as, for example, adhesives, clips, etc.) to form the hermetically sealed tank assembly. In one such embodiment, fluid enters the tank assembly through at least one inlet associated with the base, and exits through at least one outlet associated with the scroll housing. In another such embodiment, utility and service connections may penetrate the tank assembly and be provided to the motor in a manner that maintains the tank assembly in a hermetically sealed condition. In yet another such embodiment, a plurality of utility and service connections provided to the motor enable electrical power of different voltages or frequencies to be used in powering the motor during operation.

In accordance with another aspect of the present invention, the scroll housing may be mounted to the drum casing in a plurality of angular orientations with respect to the axis of the drum casing. In one such embodiment, the scroll housing may be substantially disc-shaped, with a diameter approximately the same as that of the substantially cylindrically shaped drum casing. In another such embodiment, the scroll housing is in the shape of a shallow right cylinder with a closed end that defines an opening. In yet another such embodiment, the at least one booster outlet is positioned near the perimeter of the scroll housing, and extends substantially tangentially with respect to the direction of rotation of the rotating fan wheel.

In accordance with another aspect of the present invention, the gas booster further comprises a sled assembly, which may be associated with the base and positioned beneath the tank assembly. In a currently preferred embodiment, when the hollow drum casing is disconnected from the base for any reason, the sled assembly may provide structural support and positional alignment to the hollow drum casing, and enable the hollow drum casing to be reconnected to the base quickly and easily.

In accordance with another aspect, the motor speed may be controlled from outside the tank assembly. In a currently preferred embodiment of the present invention, the motor is an alternating current (AC) motor, and the speed of the motor may be manipulated by changing the frequency of the AC power provided to the motor. In another such embodiment, the AC frequency may be controlled by the use of a variable frequency drive controller. In another embodiment, the motor is a direct current (DC) motor, and the speed of the motor may be manipulated by changing the source voltage of the DC power provided to the motor.

One advantage of the gas booster system and method of the present invention is that aligning the motor and fan wheel within the hermetically-sealed tank assembly and along the axis of the hollow drum casing permits the motor to be cooled by the flow of fluid through the booster, thereby convectively transferring heat generated by the operating motor to the flowing fluid. Because the motor is positioned inside the tank assembly, and within the fluid flow path, the motor may be cooled by the flowing fluid, and pressure losses may be eliminated. Another advantage of the gas booster system and method of the present invention is that the versatile electrical feedthrough connection permits the motor to be powered from a variety of power sources. Because proper and sufficient electrical power may be provided through a single feedthrough connector, the booster may be installed into a variety of fluid systems without requiring a manual reconfiguration of the electrical connections within the tank assembly, thereby maintaining the hermetic seal of the tank assembly and improving the electrical safety of the booster system. Still another advantage of the gas booster system and method of the present invention is that the discharge piping may be oriented in any number of positions with respect to the tank assembly, which permits the booster system and method to be installed and used in fluid systems located in confined spaces, without requiring significant renovation of the surrounding area or realignment of the fluid system piping. Finally, another advantage of the gas booster system and method of the present invention is that the tank assembly may be readily opened for maintenance, repair, inspections or any other reason, and also restored to service, more quickly and easily than booster systems of the prior art.

These and other unique features of the systems and methods disclosed herein will become more readily apparent from the following detailed description, the accompanying drawings, and any appended claims.

DETAILED DESCRIPTION OF THE INVENTION

Figure 1:
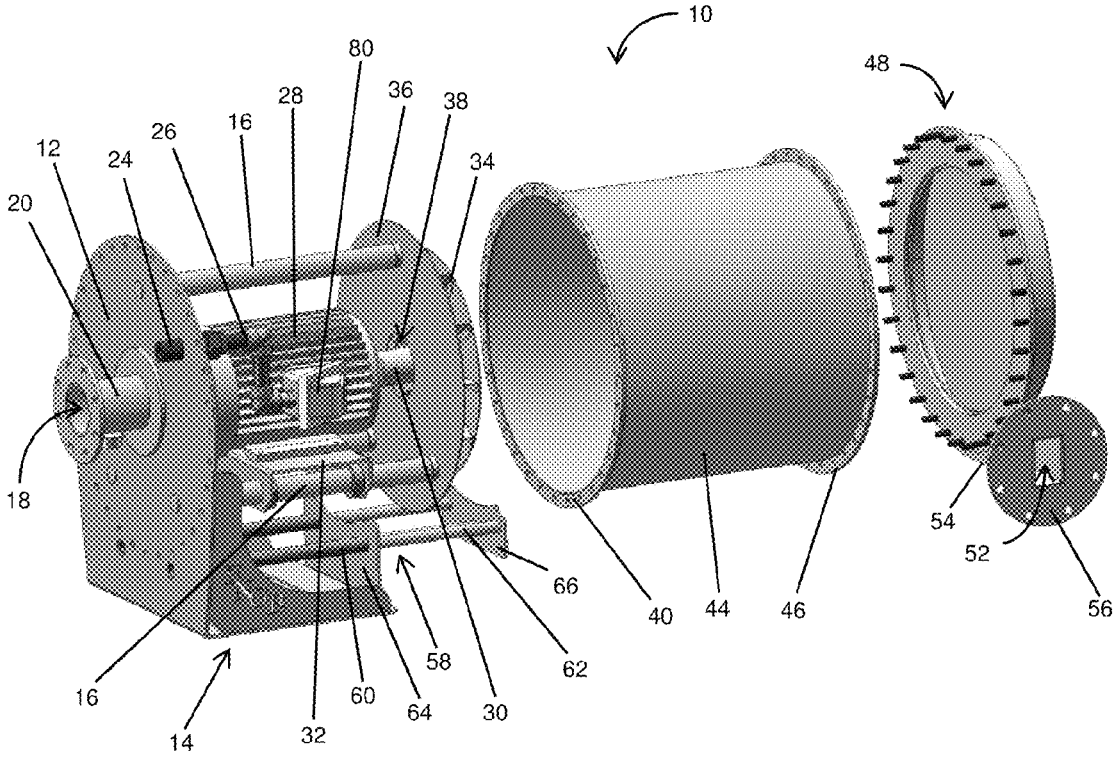
FIG. 1 is a right perspective exploded view of a gas booster according to a preferred embodiment of the present invention.

The subject disclosure and present invention relate to improved systems and methods for increasing the pressure of piped fluids. As will be readily appreciated by those skilled in the pertinent art, the systems and methods disclosed herein are particularly applicable in natural gas or propane systems, but may be utilized or employed in many applications to increase the pressure of a variety of piped fluids. The advantages and other features of the systems and methods disclosed herein will become more readily apparent from the following detailed description of certain currently preferred embodiments of the invention taken in conjunction with the drawings, which set forth representative embodiments of the present disclosure.

In FIGS. 1, 2, 3A, 3B and 4, an embodiment of a gas booster of the present invention is indicated generally by the numeral 10. Gas booster 10 comprises base 12, motor 28, fan wheel 34, hollow casing (e.g. a drum), baffle plate 36, scroll housing 48, and sled assembly 58. Motor 28 is mounted within drum 44 on motor base 32, and is supported by a plurality of support tubes 16. The respective proximal ends of the plurality of support tubes 16 are cantilever-mounted to base 12, while baffle plate 36 is mounted to the respective distal ends of support tubes 16. The gas booster 10 of FIGS. 1, 2, 3A, 3B and 4 can be utilized in a fluid system alone or in combination with other booster systems, such as in a duplex-type configuration, and can be aligned in series or in parallel with other booster systems depending on the desired flow characteristics, pressure gain, and/or other desired operating conditions of the fluid system.

In the currently preferred embodiment shown in FIGS. 1, 2, 3A, 3B and 4, motor 28 and fan wheel 34 are mounted within a hermetically-sealed tank assembly 68 formed by base 12, drum 44 and scroll housing 48. Drum 44 is substantially in the shape of a hollow right cylinder with flanged ends, and is mounted substantially horizontally to base 12, which is supported by foundation 14. Base flange 40 is formed at the perimeter of the proximal end of drum 44 for releasable mounting to base 12, while scroll flange 46 is formed at the perimeter of the distal end of drum 44 for releasable mounting to scroll housing 48. In the illustrated embodiment, the proximal end of drum 44 is releasably flange-sealed to base 12 by a plurality of threaded connectors 76 passing through a corresponding plurality of aligned holes 74 in base 12 and base flange 40, and torqued to nuts 78. Similarly, the distal end of drum 44 is releasably flange-sealed to scroll housing 48 by a plurality of threaded connectors 76 passing through a plurality of aligned holes 74 in scroll housing 48 and scroll flange 46, and torqued to nuts 78 (see, for instance, FIG. 9). Also, base gasket 42 is positioned coaxially between base flange 40 and base 12, and scroll gasket 50 is positioned coaxially between scroll flange 46 and scroll housing 48.

Figure 6:
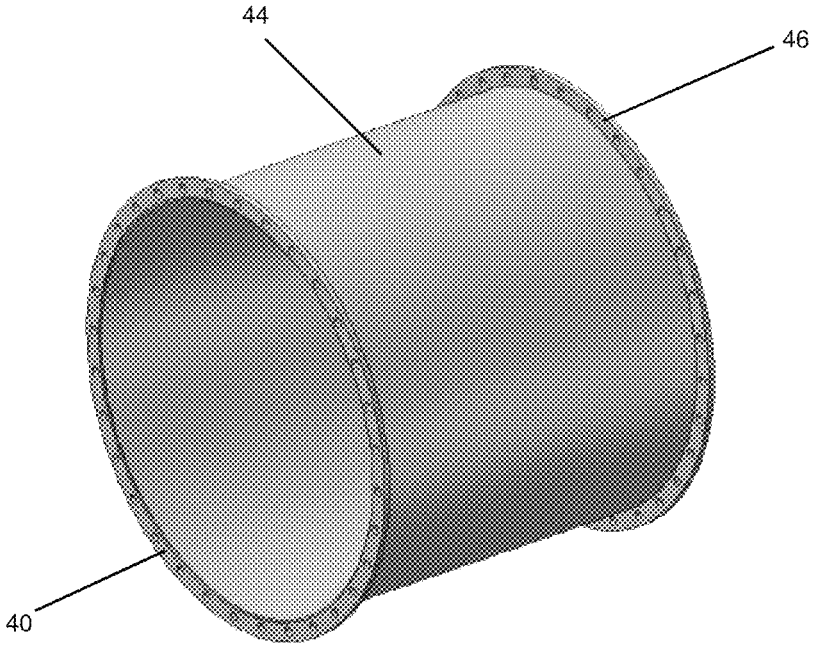
FIG. 6 is a right perspective view of the drum of the gas booster of FIG. 1.

Drum 44 of a currently preferred embodiment of gas booster 10 is shown in FIG. 6. Currently, the preferred diameters of drum 44 may range from ten inches (10") to thirty-six inches (36"). However, as will be obvious to those of skill in the art, drums of any diameter may be utilized in accordance with the present invention, as is necessary to accommodate a predetermined flow rate and pressure gain in the fluid system, and to accommodate the associated motor 28 and fan wheel 34. In a preferred embodiment of the present invention, drum 44, fan wheel 34 and baffle plate 36 should be aligned coaxially, with the diameter of drum 44 slightly exceeding the diameter of either fan wheel 34 or baffle plate 36. However, as will be recognized by those of skill in the art, drum 44 may be of any shape or size, and the hermetically sealed tank assembly 68 may be formed by any releasably sealable connection between drum 44 and base 12, and between drum 44 and scroll housing 48, in accordance with the present invention. Furthermore, drum 44 may be formed from any material, and in any manner. In the currently preferred embodiment of the present invention, drum 44 is formed from one-eighth inch (⅛") thick carbon steel that is laser-cut and rolled, with three-eighths inch (⅜") thick carbon steel flange rings fillet-welded to each of its ends.

Figure 4:
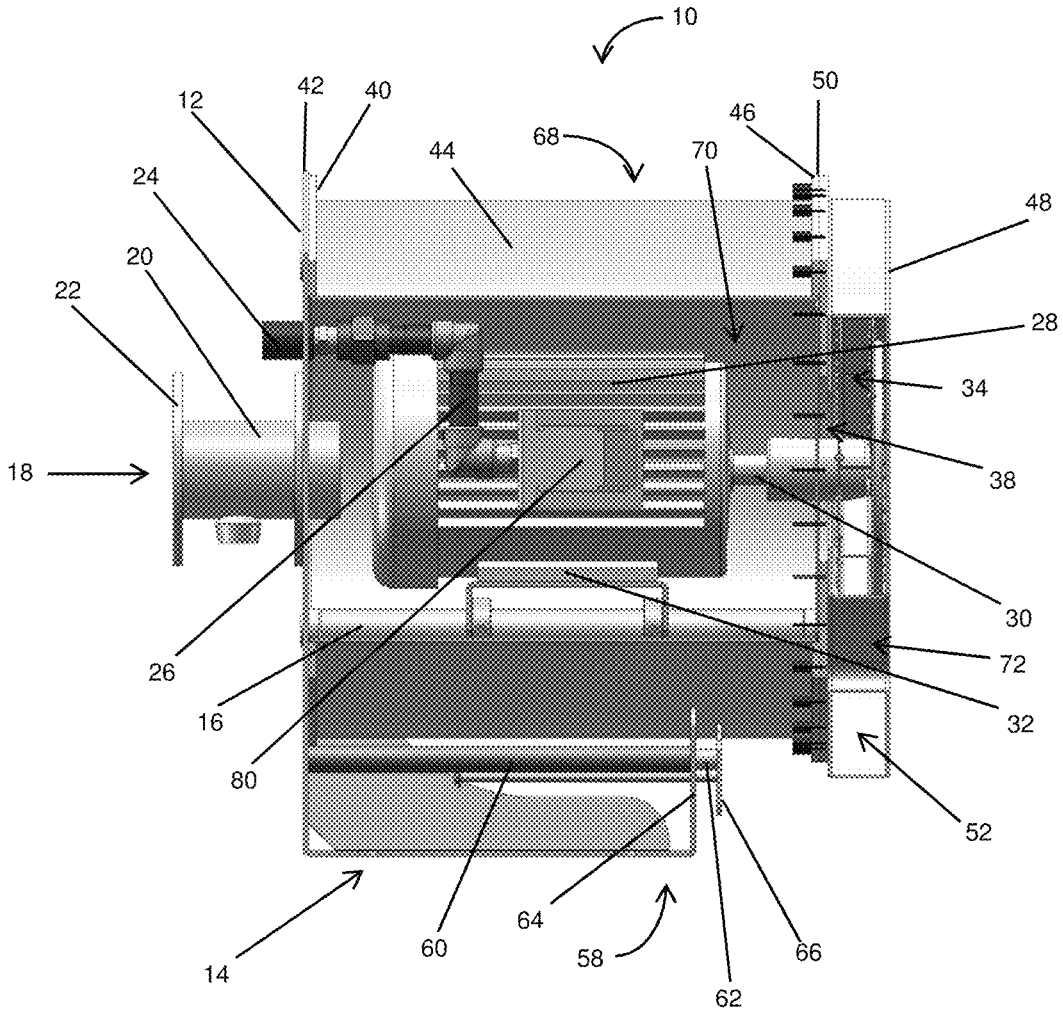
FIG. 4 is a right side sectional view of the gas booster of FIG. 1, taken along section line A-A of FIG. 3A and FIG. 3B.
Figure 7A:
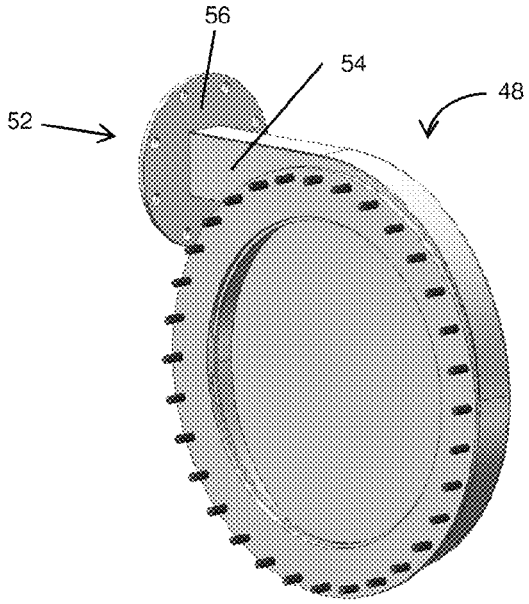
FIG. 7A is a rear perspective view of the scroll housing of the gas booster of FIG. 1, showing the inner portion of the scroll housing.
Figure 7B:
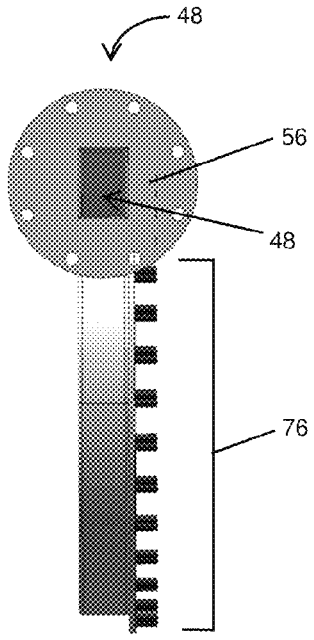
FIG. 7B is a left side view of the scroll housing of the gas booster of FIG. 1.
Figure 7C:
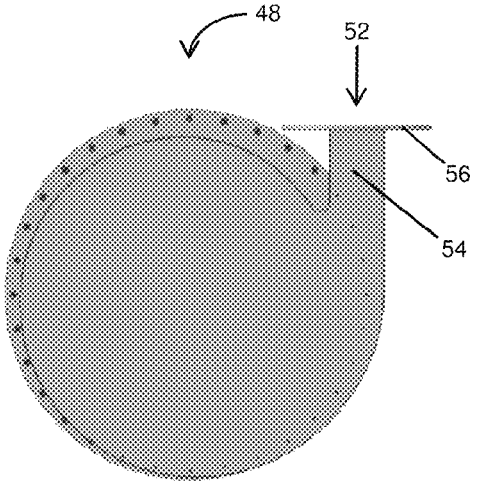
FIG. 7C and FIG. 7D are front and rear side views, respectively, of the scroll housing of the gas booster of FIG. 1.
Figure 7D:
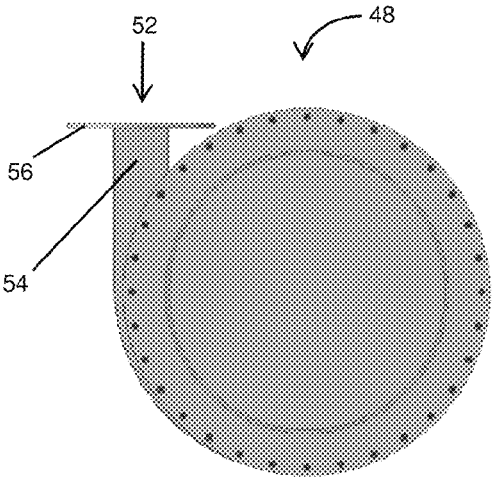

As is shown in FIGS. 1, 2, 3A, 3B and 4, scroll housing 48 comprises outlet 52 and outlet flange 46, and is flange-sealed to scroll flange 56 of drum 44. In the preferred embodiment illustrated in FIGS. 7A-7D, scroll housing 48 is substantially in the shape of a hollow, shallow right cylinder with an open proximal end and a closed distal end, defining an opening therein. Scroll housing 48 forms a portion of hermetically sealed tank assembly 68, and directs the compressed gas out of tank assembly 68 by way of outlet 52. In the illustrated embodiment, scroll housing 48 is aligned coaxially with drum 44, and its length is approximately equal to the width of fan wheel 34, as is shown in FIG. 4, such that when scroll housing 48 is flange-sealed to drum 44, and gas booster 10 is in operation, fan wheel 34 rotates within the opening defined by scroll housing 48. In the currently preferred embodiment illustrated in FIGS. 3B, 7A and 7C, outlet connector 54 extends substantially tangentially with respect to the perimeter of scroll housing 48, and in the direction of rotation of fan wheel 34.

In the embodiment shown in FIGS. 1, 2, 3A, 3B and 4, scroll housing 48 and base 12 are mounted to drum 44 by a plurality of threaded connectors 76. The flange-sealed connections between drum 44 and base 12, and between drum 44 and scroll housing 48, enable these components to be connected to or disconnected from one another quickly and easily. Furthermore, the number of threaded connectors 76 utilized to mount the scroll housing 48 to drum 44 determines the number of possible configurations of outlet 52. When n threaded connectors 76 are utilized to mount the scroll housing 48 to drum 44, and the n threaded connectors 76 are spaced equidistantly along the perimeter of the mated surfaces, scroll housing 48 may be positioned in n distinct angular orientations, and the angular variation of each distinct orientation, in degrees, is calculated by the equation 360/n. In FIGS. 7A-7D, an exemplary scroll housing 48 is shown with thirty-two threaded connectors 76 spaced substantially equidistantly along its perimeter. Naturally, those of skill in the art will recognize that the illustrated scroll housing 48 may be mounted to drum 44 in thirty-two distinct angular orientations rotated about the longitudinal axis of drum 44, with each angular orientation varying by approximately 11.25 degrees. Because of this versatility, outlet 52 may also be positioned in thirty-two distinct positions, enabling gas booster 10 to be installed more easily into any fluid system, including such systems with unique piping alignments or geometric constraints.

Figure 2:
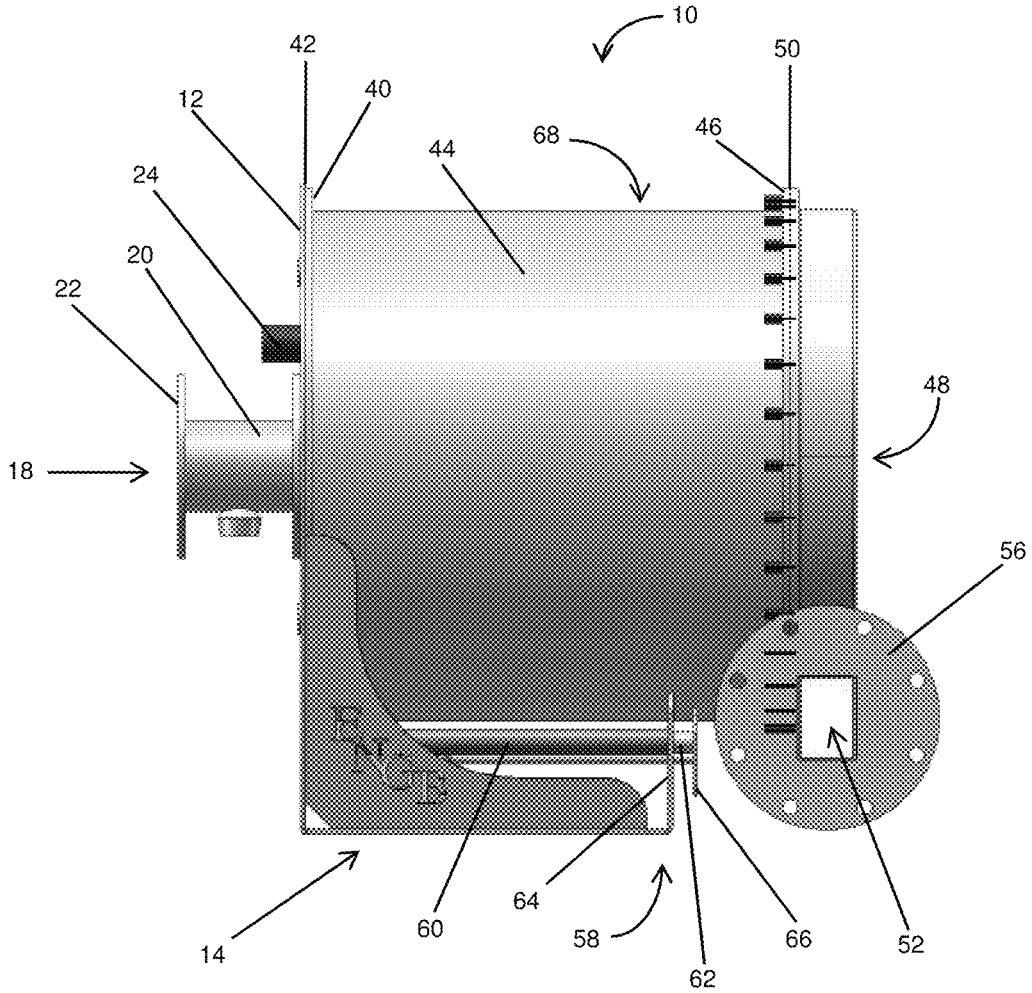
FIG. 2 is a right side view of the gas booster of FIG. 1, with the gas booster assembled.
Figure 3A:
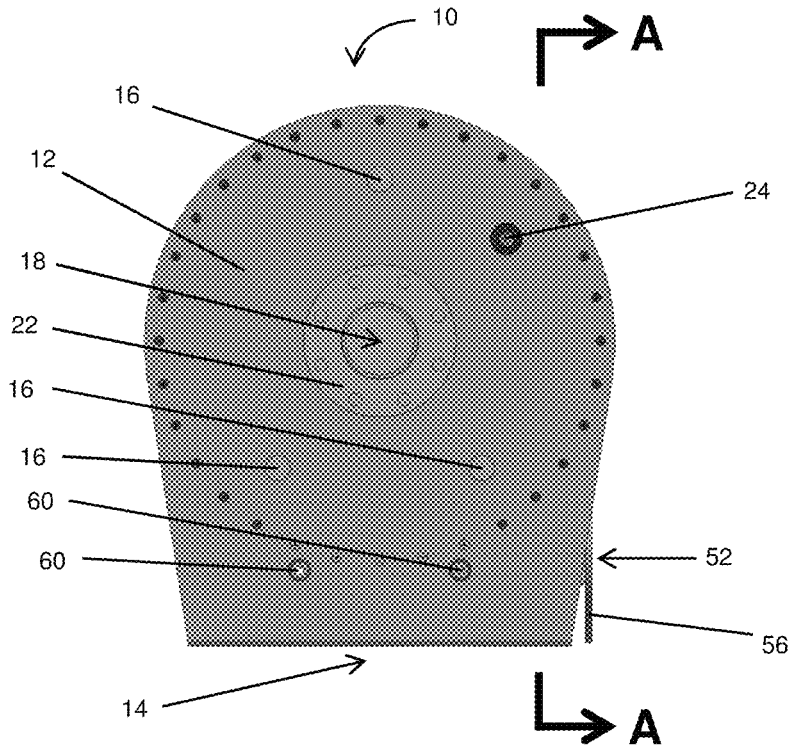
FIG. 3A and FIG. 3B are rear side and front side views, respectively, of the gas booster of FIG. 1.
Figure 3B:
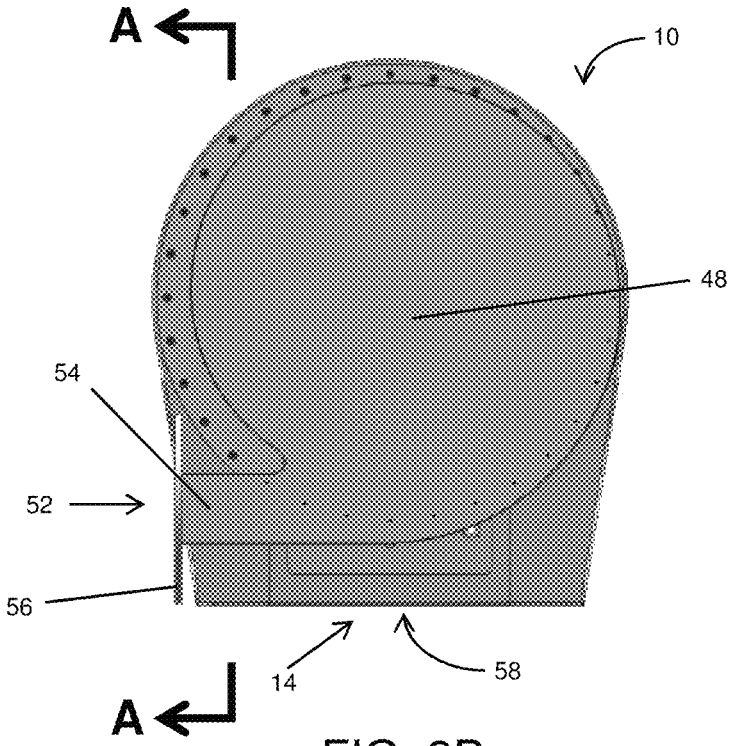

The number and type of threaded connectors 76 used to mount scroll housing 48 to drum 44 may be determined based on the design pressure and flow capacity of gas booster 10 and the piped fluid system, and also the number of desired angular configurations of outlet 52. Threaded connectors 76 may be bolts, welded studs or any other form of connection. As is shown in FIG. 2 and FIG. 4, base gasket 42 is compressed between base 12 and base flange 40, and scroll gasket 50 is compressed between scroll flange 46 and scroll housing 48. Base gasket 42 and scroll gasket 50 are typically thin, compressible concentric ringed materials aligned substantially coaxially with drum 44 and placed between and along the entire perimeter of the mating surfaces. Base gasket 42 and scroll gasket 50 aid in creating the hermetic seal between structural components upon compression, and may be formed from any materials, of any thickness. A one-eighth inch (⅛") thick ring layer of cork is currently preferred, but polytetrafluoroethylene (PTFE), silicone or similar materials may also be used. In the currently preferred embodiment of the present invention, drum 44 is mounted to base 12 by ½-13 flanged bolts, each torqued to approximately sixty-five foot-pounds (65 ft-lb), and drum 44 is mounted to scroll housing 48 by threaded studs welded to scroll housing. Base gasket 42 and scroll gasket 50 are placed between the respective mating surfaces prior to torquing nuts 74 to threaded connectors 76 and forming the seal. Those of skill in the art will recognize that any means of sealing the components of the present invention may be used to form the hermetic seal, and neither threaded connectors nor gaskets need be used if tank assembly 68 may be hermetically sealed by other means, such as clips or adhesives.

In the embodiment illustrated in FIGS. 1, 2, 3A, 3B and 4, fan wheel 34 is fixedly mounted to motor shaft 30, such that when motor 28 is energized, motor shaft 30 is rotatably driven by motor 28, and fan wheel 34 is similarly driven. As is shown in FIG. 4, motor shaft 30 extends beyond the length of drum 44 in the axial direction in the assembled tank assembly 68, such that fan wheel 34 rotates within the opening defined by scroll housing 48. In the currently preferred embodiment, fan wheel 34 is a double-walled cylindrical radially-bladed centrifugal fan wheel, which receives fluid into its center, and expels fluid outward in a radial direction. However, as may be recognized by those skilled in the pertinent art based on the teachings herein, fan wheel 34 may take any of numerous different configurations that are currently known, or later become known, to those of skill in the art. Moreover, although the embodiment illustrated in FIGS. 1, 2, 3A, 3B and 4 comprises just one fan wheel 34, a plurality of fan wheels may be axially disposed relative to each other within tank assembly 68, in accordance with the present invention.

As is shown in FIG. 1 and FIG. 4, gas booster 10 further comprises baffle plate 36 interposed between the rotating fan wheel 34 and the motor 28. Preferably, baffle plate 36 has a shape corresponding to that of drum 44, and further comprises baffle hole 38, through which motor shaft 30 passes. For example, in the embodiment shown in FIGS. 1-2, baffle plate 36 is shaped like a substantially circular disc, with a substantially circular baffle hole 38 through which motor shaft 30 extends. The illustrated baffle plate 36 is supported within tank assembly 68 by a plurality of support tubes 16, and also acts as a barrier between inlet plenum 70 and outlet plenum 72, within tank assembly 68. As is shown in FIG. 4, outlet plenum 72 substantially comprises the opening defined by scroll housing 48.

Figure 5A:
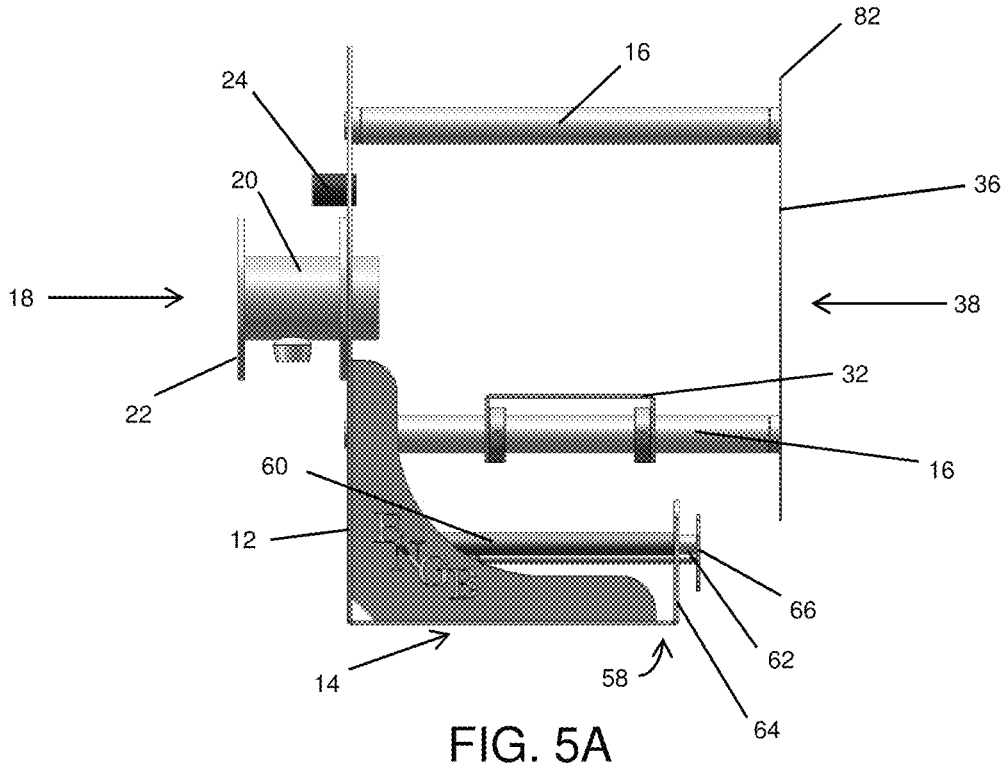
FIG. 5A and FIG. 5B are right side and right perspective views, respectively, of the base, foundation, inlet, sled assembly, support tubes, motor base and feedthrough connector of the gas booster of FIG. 1.
Figure 5B:
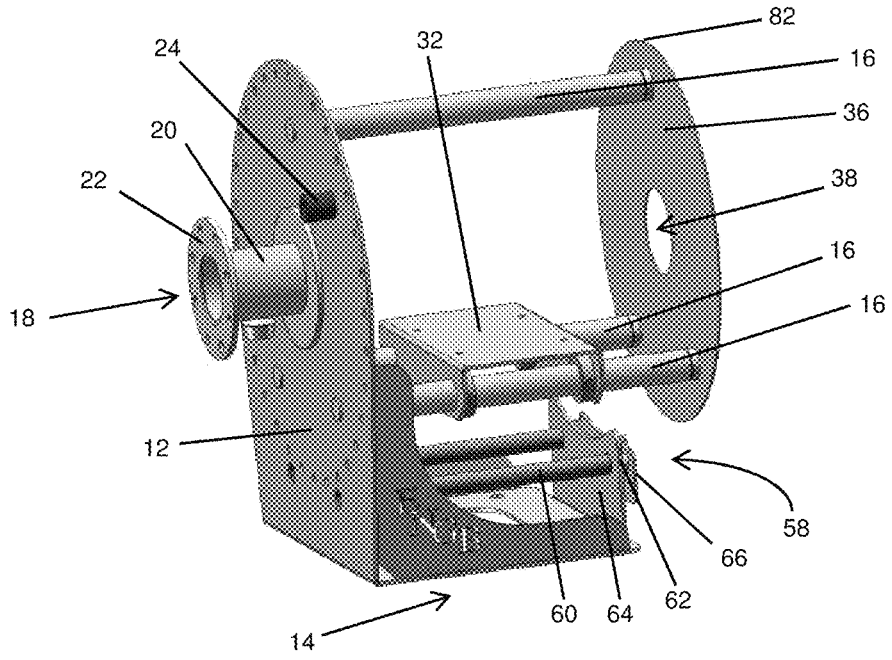
Figure 9:
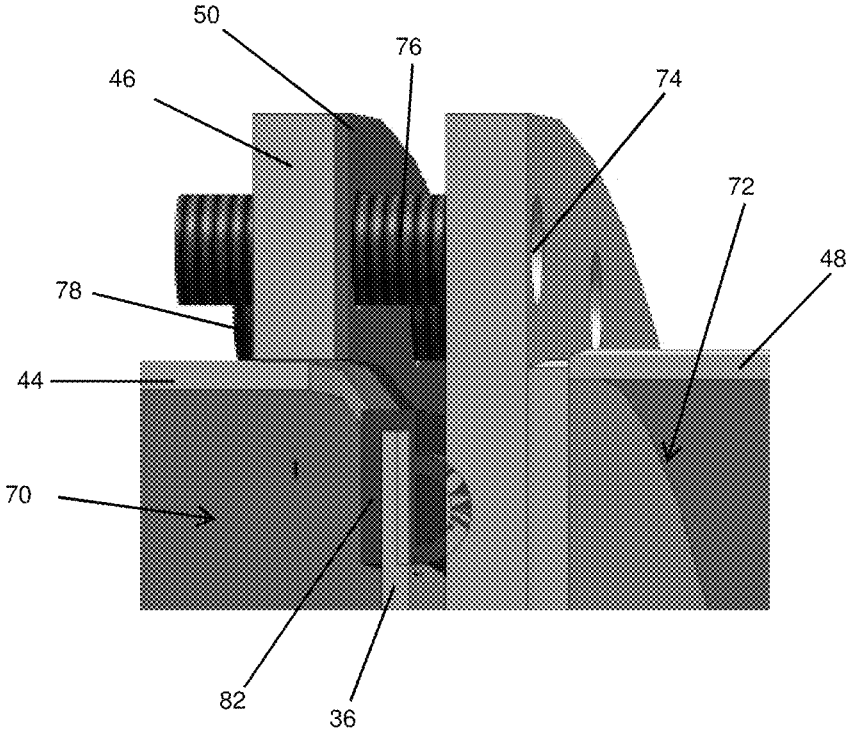
FIG. 9 is a cross-sectional view of a portion of the connection between the scroll housing and the drum of the gas booster of FIG. 1.

FIGS. 5A and 5B illustrate a preferred configuration of baffle plate 36, and depict a plurality of support tubes 16 providing support to baffle plate 36 and motor base 32. In the embodiment illustrated in FIGS. 1, 2, 3A, 3B and 4, when gas booster 10 is in operation, piped gas enters inlet plenum 70 of tank assembly 68 through inlet 18 via a piped inlet 20, which may be attached to the piped gas via a flange 22, and passes through baffle hole 38 into outlet plenum 72, and comes into contact with the rotating fan wheel 34. The rotation of fan wheel 34 performs work on the gas, elevating its pressure and directing the gas out of tank assembly 68 by way of outlet 52. The flow of gas through gas booster 10 tends to pass across and around the electrical components of motor 28, convectively self-cooling motor 28 during operation. Baffle plate 36 has an outer diameter slightly less than that of drum 44, and motor shaft 30 and baffle plate 36 are substantially coaxial with drum 44. As is shown in FIG. 1, when drum 44 is mounted to base 12, the outer circumferential rim of baffle plate 36 nearly abuts the inner circumferential surface of drum 44, but with sufficient mechanical clearance to allow drum 44 to be easily disconnected and removed from base 12. Baffle gasket 82 may also be placed along the outer diameter of baffle plate 36, to form a releasable seal between the outer diameter of baffle plate 36 and the inner circumferential surface of drum 44. FIG. 9 shows a close-up, cross-sectional view of a portion of the connection between scroll housing 48 and drum 44, in which scroll gasket 50 is positioned substantially axially between scroll housing 48 and scroll flange 46, and baffle plate 36 separates inlet plenum 70 from outlet plenum 72. FIG. 9 also shows baffle gasket 82 positioned along the outer perimeter of baffle plate 36, abutting the inner circumferential surface of drum 44. Baffle gasket 82 may be formed of rubber, silicone or other like materials, or any other material that may be applied to the outer perimeter of baffle plate 36 to form a releasable seal with the inner circumferential surface of drum 44.

Preferably, motor 28 is an explosion-proof, electrically powered three-phase alternating current (AC) motor, although other types of motors which may operate on either direct current (DC) or AC power at any frequency, may be utilized in the present invention. A motor 28 comprising any number of AC power phases of rotation, including single-phase, three-phase, or others, may also be utilized in the present invention. Moreover, motors of any power rating may be utilized, depending on intended use of the gas booster. Currently, motors with horsepower ratings from 0.5 HP to 10 HP are presently preferred for use in gas boosters of the present invention. Furthermore, motors which operate at any voltage level may be utilized in the present invention, including low voltage (such as 120, 208 or 230 volts), or high voltage (such as 460 volts) motors.

Figure 8:
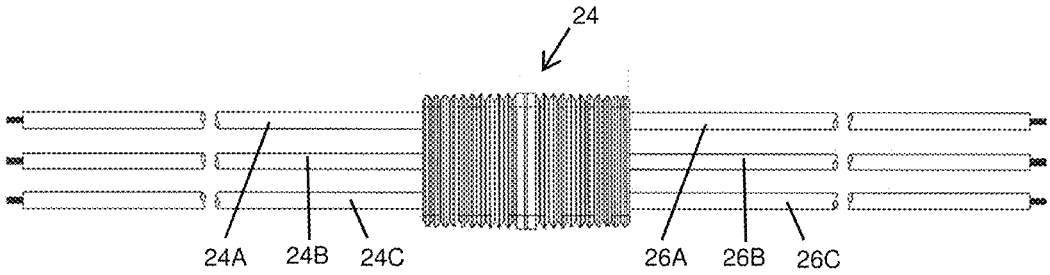
FIG. 8 is a side view of a typical feedthrough connector of the gas booster of FIG. 1.

In the currently preferred embodiment of the present invention shown in FIGS. 1, 2, 3A, 3B and 4, the necessary wiring connections for powering the motor 28 enter tank assembly 68 through base 12 by way of feedthrough connector 24, which maintains the hermetically sealed condition on tank assembly 68. In a typical feedthrough connector 24, shown in greater detail in FIG. 8, wires 24A, 24B, 24C are bound within a threaded, substantially cylindrical adapter, and separated within the connector by a non-conductive, dielectric insulator, and wires 26A, 26B, 26C extend from connector 24 for mounting to junction box 80 by way of conduit 26. A typical conduit 26 linking feedthrough connector 24 to junction box 80 on motor 28 is shown in FIG. 1 and FIG. 4. Preferred feedthrough connectors which may be utilized in the present invention include those manufactured by Douglas Electrical Components, Inc., of Randolph, N.J. In a currently preferred embodiment, feedthrough connector 24 is a threaded aluminum adapter approximately one inch in diameter, and contains twelve copper wiring leads separated within the connector dielectric insulator compound, although any feedthrough apparatus or suitable means for permitting electrical or service connections to enter the hermetically sealed tank assembly 68 and link with the motor 28 may be utilized in accordance with the present invention.

In a preferred embodiment, conduit 26 contains all of the necessary wires required to operate motor 28 at a variety of voltages, and may be wrapped in rubber or other like material, sheathed, or protected in any other manner within tank assembly 68. Those of skill in the art will recognize that conduit 26 may include power connections, such as three wires for a typical single-phase motor, four wires for a typical three-phase motor, or others; grounding wires; motor control connections; monitoring connections; or connections for any other purpose. Conduit 26 may be connected to feedthrough connector 24 and the terminal connections within junction box 80 when the booster is assembled, thereby avoiding the need to realign wires or power connections to junction box 80 in the field. Because gas boosters may be used in fluid systems carrying volatile fluids such as natural gas or propane, realigning power connections within the tank assembly 68 may create a spark hazard or create an electric short, which could create an explosion risk. In a preferred embodiment, conduit 26 comprises twelve wires extending between feedthrough connector 24 and junction box 80, including nine wires for providing dual-voltage AC power, one ground wire, and two wires for connecting the motor to control circuitry, which can shut down the booster once any undesired condition (such as temperature, pressure, humidity, motor speed, flow rate, etc.) is sensed. Preferably, the dual-voltage AC power connections are mated from feedthrough connector 24 to junction box 80 when gas booster 10 is assembled, so that the power connections need not be revised, regardless of the available power where gas booster 10 is installed. The wires in conduit 26 may be connected to junction box 80 as is described in Robert L. Smith and Stephen L. Herman, *Electrical Wiring, Industrial* (Cengage Learning, 2004), at 97-101, which describes three-phase and single-phase dual-voltage AC motor connections, or in any sufficiently versatile manner which would permit gas booster 10 to be installed into a plurality of power environments.

It may also be appreciated by those of skill in the art that motor 28 may operate at any desired speed in accordance with the present invention, and may rotate motor shaft 30 in any direction of rotation. In AC motors, the rotating speed of the motor is typically a function of AC power frequency, while in DC motors, the rotating speed of the motor is typically a function of DC power source voltage. Therefore, by altering the operating frequency of the AC power provided to an AC motor, or by altering the source voltage provided to a DC motor, the motor's speed or direction of rotation may be changed. The ability to control the direction or speed of rotation enables operators of the gas booster 10 to safely start up or shut down the system, to precisely control the pressure gain, or to optimize electric power consumption. In a currently preferred embodiment of the present invention, motor 28 is an AC motor, and the frequency of the AC power applied to motor 28 by way of feedthrough connector 24 may be manipulated through the use of a variable frequency drive controller. An exemplary use of a frequency drive controller on a gas booster is described in Olson et al. Preferred variable frequency drive controllers which may be utilized in the present invention include those manufactured by Baldor Electric Company of Fort Smith, Ark. However, any device or means for altering the frequency or voltage of the power applied to the motor, or the speed or direction of rotation of the motor itself, may be utilized in accordance with the present invention.

In a preferred embodiment, as is shown in FIGS. 1, 2, 3A, 3B and 4, sled assembly 58 further comprises sled arms 60, sled extenders 62, sled frame 64 and sled support 66, which are positioned beneath drum 44. In the illustrated embodiment, sled frame 64 is mounted to foundation 14, and also to base 12 by way of sled arms 60, which, like support tubes 16, are cantilever-mounted to base 12. Sled support 66 is mounted to sled extenders 62 which, in the illustrated embodiment, may extend telescopically from sled arms 60, as is shown in FIG. 5B. During periods when gas booster 10 is not in operation—such as during maintenance, repair, inspection or emergencies—drum 44 may be detached from base 12 and separated away from base 12 in the axial direction to allow access to the contents of the tank assembly 68, including motor 28, fan wheel 34, or other components. However, when drum 44 is to be reattached to base 12, it must be carefully repositioned around baffle plate 36 and aligned with base 12. Depending on the size and operating characteristics of gas booster 10, drum 44 can be several feet in diameter and can weigh hundreds of pounds. Thus, as is shown in FIG. 5B, sled assembly 58 provides a significant advantage by maintaining structural support and axial alignment to drum 44 when it is disconnected from base 12, thereby minimizing the amount of labor and time required to access the contents of the tank assembly 68 to perform maintenance, inspection, repairs or for other reasons, and also reduces the time required to restore the gas booster 10 to service following such entry. In currently preferred embodiments, sled assembly 58 may enable a single man to detach drum 44 from base 12, and easily return it to its appropriate position.

As will be recognized by those of skill in the art, the components of the gas booster 10 of the present invention may be of any shape or size, and fabricated from any suitable material without limiting the scope of the present invention, which may be utilized on any kind of fluid system. For example, drums, bases, fan wheels and scroll housings may be formed from any material, grade or thickness, including plastics, composites, polycarbonates, fiberglass, metals of any kind, or any other suitable material. In addition to power, other services, such as greasing connections, may also enter the hermetically sealed tank assembly by way of a feedthrough connector. Furthermore, the drum and scroll housing may constitute a singular unit, so that both the drum and scroll housing may be rotated, repositioned or replaced as necessary. Moreover, the inlet and outlet connections to the booster system need not be flanged at all, and may include any other method for linking the booster system to pipes or other conduits in fluid systems. Any type of fan wheel may be utilized with the present invention, and the outlet may be aligned accordingly. For example, if an axial fan wheel is utilized with the present invention, it may be desired to align the outlet axially, not tangentially. Also, the sled assembly may be mounted or configured in any relation to the tank assembly. For example, in a horizontally-aligned gas booster, the sled assembly may include related components located above or alongside the drum, as well as beneath it. If the gas booster is aligned substantially vertically, the sled may lie beneath the drum in the vertical direction, and may include springs, pulleys or other systems for structurally supporting or aligning the drum when it is disconnected from the base. The sled assembly may also utilize tracks, bearings, rollers or other components to support or align the drum when the tank assembly is disassembled.

While the present invention has been described herein with respect to certain currently preferred embodiments, it will be appreciated by those skilled in the art that the principles and inventive concepts could be applied in any of numerous different applications. Further, those skilled in the art will readily appreciate that various changes and/or modifications can be made to the embodiments described above, and to other embodiments, without departing from the spirit or scope of the invention as defined in any appended claims. For example, the components of the gas booster may be made of any of numerous different materials, or may take any of numerous different sizes, shapes and/or configurations that are currently known, or later become known. Additionally, the inlet or the outlet may be aligned axially or radially, or tangentially with respect to the rotation of the fan wheel, and connections to the inlet or the outlet may be rigid or flexible, and may take any of numerous different configurations. Furthermore, although the exemplary embodiments disclosed herein are shown in a substantially horizontal orientation, the gas boosters of the present invention may be positioned in any angular orientation, such as vertically or at any other angle other than horizontal. Gas boosters of the present invention may define any of a variety of different shapes and/or sizes to accommodate different applications and/or different uses of piped gas. For example, the devices may be provided in different sizes to accommodate various commercial, industrial or residential uses, or may be provided with differently sized motors and/or fan wheels, to accommodate different design flow capacities and/or pressure gains. Moreover, gas boosters of the present invention may be provided in standard sizes, or the sizes of select components of the device may be adjustable or custom-sized for different uses and/or applications. Accordingly, this detailed description of preferred embodiments is to be taken in an illustrative sense, as opposed to a limiting sense.

What is claimed is:

1. A gas booster for increasing a pressure of a volatile gas stream flowing therethrough, the booster comprising:

a foundation;

a base supported by the foundation and configured for supporting a tank assembly in a cantilevered fashion, the tank assembly comprising a hollow casing having a proximal end and a distal end and configured to enclose an explosion-proof motor and more than one support member, wherein the more than one support member extends from the base to a baffle plate, the baffle plate having a proximal surface, a distal surface and an outer radial surface;

a rotatable scroll housing having an open end and a closed end, wherein each of the proximal end and the distal end of the hollow casing comprising a releasable connection to releasably connect the hollow casing to the base and scroll housing respectively; and a baffle gasket positioned between an inner circumferential surface of the distal end of the hollow casing and the outer radial surface of the baffle plate, and between the distal surface of the baffle plate and the scroll housing, wherein the explosion-proof motor is positioned between the base and the baffle plate within the tank assembly and supported by at least one of the more than one support member, and the explosion proof motor comprises a shaft and a fan wheel extending from the shaft, the fan wheel positioned within the scroll housing and configured to increase the pressure of the volatile gas stream flowing therethrough, wherein the gas booster is capable of increasing the pressure of the volatile gas stream and when in use the volatile gas stream flows within and through the hollow casing from the base through the scroll housing, wherein the hollow casing, baffle gasket, baffle plate and scroll housing seal the tank assembly when the hollow casing is connected to the base and the scroll housing is connected to the hollow casing and when the volatile gas stream is flowing within the tank assembly, and wherein the motor is convectively cooled by the volatile gas stream flowing through the hollow casing.

2. The gas booster of claim 1, further comprising a sled provided beneath at least a portion of the hollow casing, wherein the sled is adapted to support at least a portion of the hollow casing when the proximal end of the hollow casing is released from the base.

3. The gas booster of claim 1, further comprising a feedthrough connector threadedly installed into the base, wherein the feedthrough connector comprises a plurality of leads extending therethrough, and wherein each of the plurality of the leads provides a conductive path from an exterior of the tank assembly to an interior of the tank assembly while maintaining the tank assembly sealed.

4. The gas booster of claim 3, further comprising a plurality of conductors within the tank assembly, wherein the explosion-proof motor comprises a plurality of leads, wherein at least two of the plurality of leads are associated with different voltage levels, and wherein each of the plurality of conductors extends between one of the leads of the feedthrough connector to one of the leads of the explosion-proof motor.

5. The gas booster of claim 4, wherein the feedthrough connector is adapted to receive power from an external power source at one of a plurality of voltage levels and to provide power to the explosion-proof motor from the external power source at the one of the plurality of voltage levels.

6. The gas booster of claim 1, further comprising a variable frequency drive controller for operating the explosion-proof motor at a desired speed.

7. The gas booster of claim 1, wherein the releasable connection between the base and the proximal end of the hollow casing comprises:

a plurality of releasable fasteners extending through a plurality of corresponding holes in a mating surface of the base and a mating surface of the proximal end of the hollow casing, and a base gasket positioned between the mating surface of the base and the mating surface of the proximal end of the hollow casing.

8. The gas booster of claim 1, wherein the releasable connection between the distal end of the hollow casing and the scroll housing comprises a plurality of releasable fasteners extending through a plurality of corresponding holes in a mating surface of the distal end of the hollow casing and a mating surface of the scroll housing, and a scroll gasket positioned between the mating surface of the distal end of the hollow casing and the mating surface of the scroll housing, wherein the scroll housing being releasably connected to the distal end of the hollow casing in a plurality of angular orientations.

9. The gas booster of claim 8, wherein the plurality of releasable fasteners and the plurality of corresponding holes are spaced equidistantly along the mating surfaces of the hollow casing and the scroll housing.

10. The gas booster of claim 9, further comprising an outlet positioned near a perimeter of the scroll housing, wherein the outlet extends from the tank assembly substantially tangentially with respect to a direction of rotation of the fan wheel.

11. The gas booster of claim 1, wherein the volatile gas stream is selected from the group comprising at least one of natural gas, propane, bio-gas, landfill gas and sewer gas.

12. The gas booster of claim 1, further wherein the explosion-proof motor is mounted to the base within the tank assembly by way of the more than one support member.

13. The gas booster of claim 12, wherein the tank assembly defines a horizontally-aligned cylinder; and wherein the explosion-proof motor is cantilever-mounted within the tank assembly to permit the fluid to flow above, below and around the explosion-proof motor within the tank assembly.

14. The gas booster of claim 12, wherein the fan wheel is a double-walled radially-bladed centrifugal fan when adapted to expel the fluid outward in a radial direction.

15. The gas booster of claim 14, wherein the baffle plate is mounted to a distal end of the more than one support member within the tank assembly between a piped inlet and a piped outlet, wherein the baffle plate defines a barrier between an inlet plenum of the tank assembly and an outlet plenum of the tank assembly, and wherein the baffle plate comprises a baffle hole connecting the inlet plenum of the tank assembly and the outlet plenum of the tank assembly.

16. The gas booster of claim 3, wherein each of the plurality of leads extending through the feedthrough connector is separated from one another by a dielectric insulator compound, and wherein the feedthrough connector maintains the tank assembly in a hermetically sealed condition.

* * * * *